United States Patent [19]

Hokama et al.

[11] Patent Number: 4,913,173

[45] Date of Patent: Apr. 3, 1990

[54] HIGH EFFICIENCY WRAP PACKAGE, AND PROCESS, FOR NAILS

[75] Inventors: Yosh Hokama, Torrance; Luis Romero, Lawndale, both of Calif.

[73] Assignee: International Beauty Distributors, Inc., Gardena, Calif.

[21] Appl. No.: 199,054

[22] Filed: May 26, 1988

Related U.S. Application Data

[63] Continuation-in-part of Ser. No. 66,267, Jun. 25, 1987, Pat. No. 4,767,648.

[51] Int. Cl.[4] ..... A45D 29/00

[52] U.S. Cl. ..... 132/73; 132/200

[58] Field of Search ..... 132/73, 285, 200; 424/61; 428/15; 156/61

[56] References Cited

U.S. PATENT DOCUMENTS 3,598,685 8/1971 Lee et al. ..... 132/320
3,885,578 5/1975 Hicks ..... 132/73
3,898,357 8/1975 Miller et al. ..... 132/73
4,627,453 12/1986 Isler ..... 132/73

*Primary Examiner*—Gene Mancene
*Assistant Examiner*—Adriene Lepiane
*Attorney, Agent, or Firm*—William W. Haefliger

[57] ABSTRACT

The strengthening of a finger or toe nail includes providing a package that includes a fabric layer to be applied to the nail, and a flexible plastic overlay sheet that includes a first portion positioned in overlying relation to a first part of the fabric layer and a second portion retained to a second part of the fabric layer, positioning the package to apply the first part of the fabric layer onto the nail and in the presence of liquid adhesive adjacent the first part of the fabric layer, and rubbing that first portion of the plastic layer against and relative to the first part of the fabric layer, thereby to smooth the first part of the fabric layer on the nail causing the adhesive to smoothly bond that first part of the fabric layer to the nail.

22 Claims, 2 Drawing Sheets

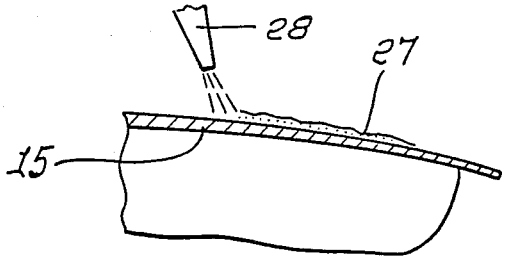
FIG. 6a.
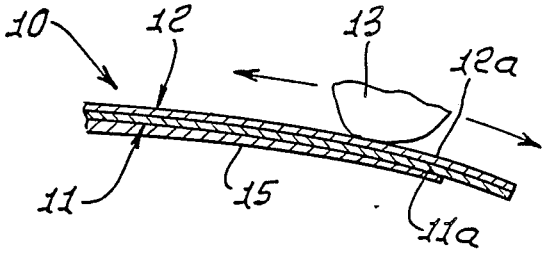
FIG. 6b.
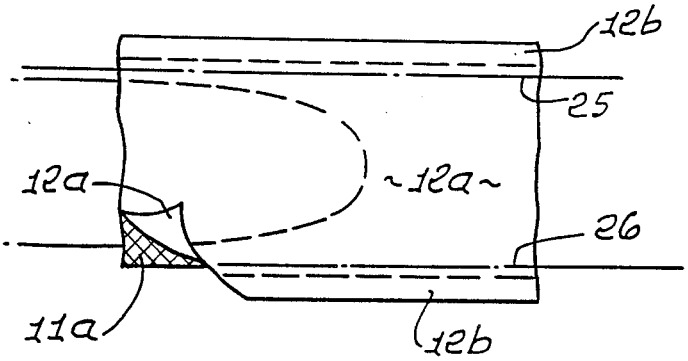
FIG. 6c.
FIG. 6d.
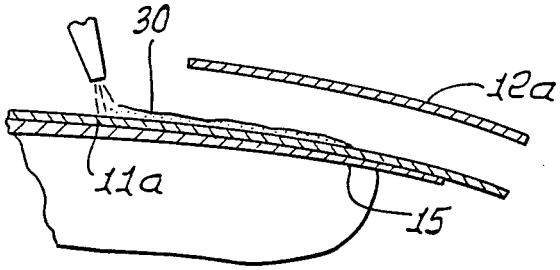
FIG. 6e.
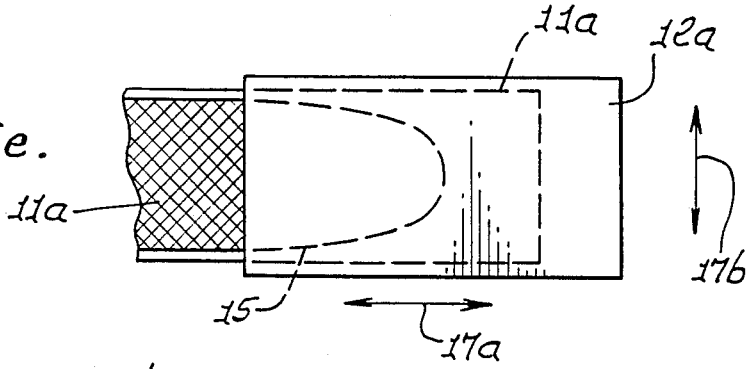
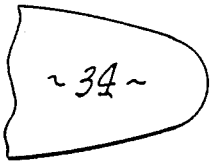
FIG. 6f.

HIGH EFFICIENCY WRAP PACKAGE, AND PROCESS, FOR NAILS

BACKGROUND OF THE INVENTION

This application is a continuation-in-part of Ser. No. 066,267, filed Jun. 25, 1987, now U.S. Pat. No. 4,767648, issued Aug. 30, 1988.

This invention relates generally to fingernail wraps, as for example are used to strengthen nails; and more specifically it concerns the use on a nail of a package that includes a fabric layer and an overlay plastic sheet, to simplify and speed up the wrap formation process.

The process of adhering fabric layers to nails, to form "wraps", has been characterized by many problems. These have included: the formation and difficulty of removal of air pockets in the glue between the fabric layer and the nail; the extremely lengthy time required to cure the glue, especially thicker or more viscous glue; and the difficulty of positioning the fabric layer on the nail while attempting to remove air bubbles or pockets from the applied glue. Other related problems and difficulties were also encountered. There is need for a means and process to eliminate these problems and difficulties.

SUMMARY OF THE INVENTION

It is a major object of the invention to provide apparatus and method to meet the above needs.

Basically, the invention in its apparatus aspects includes:

(a) a flexible package that includes a fabric layer to be applied to the nail, and a flexible plastic overlay sheet, (b) the overlay sheet including first and second portions, and the fabric layer including first and second parts, said second portion retained to said second part, and said first portion free of attachment to said first part, (c) the package sized to be positioned with said first part of the fabric layer applied onto the nail in the presence of liquid adhesive, whereby rubbing of said first portion of the overlay sheet against and relative to said first part of the fabric layer effects smoothing of said first part of the fabric layer causing the adhesive to smoothly bond said first part of the fabric layer to the nail.

As will be seen a plastic layer composition is made such (as for example polypropylene) as to greatly accelerate the curing of the adhesive, as when the latter consists of cyanoacrylate. Also, the overlay sheet is typically retained to the fabric layer as by heat seal zones that extend as narrow bands spaced apart at opposite sides of the first portion of the overlay sheet and of the first part of the fabric layer to enable rubbing of the former on and relative to the latter, to accelerate the adhesive cure.

The basic method of the invention includes the steps:

(a) providing a package that includes a fabric layer to be applied to the nail, and a flexible plastic overlay sheet that includes a first portion positioned in overlying relation to a first part of the fabric layer and a second portion retained to a second part of the fabric layer, (b) positioning said package to apply said first part of the fabric layer onto the nail and in the presence of liquid adhesive adjacent said first part of the fabric layer, (c) and rubbing said first portion of the plastic layer against and relative to said first part of the fabric layer, thereby to smooth said first part of the fabric layer on the nail causing the adhesive to smoothly bond said first part of the fabric layer to the nail.

The method also typically includes disassembling the package after said rubbing to remove the plastic overlay sheet from the fabric layer; and such disassembly typically is carried out by severing the heat sealed zones from the first part of the fabric layer. Also, additional adhesive is then applied to the adhering fabric layer and that adhesive is rubbed with the removed overlay sheet, to accelerate curing, whereby, after trimming, an attractive, durable, strong wrap is provided.

These and other objects and advantages of the invention, as well as the details of an illustrative embodiment, will be more fully understood from the following specification and drawings, in which:

DRAWING DESCRIPTION

Figure 1:
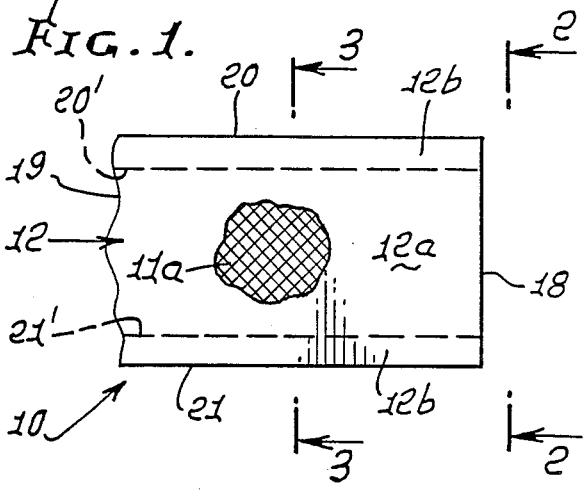
FIG. 1 is a plan view showing a package incorporating the invention; and locally cut-away to show interior structure.
Figure 4:
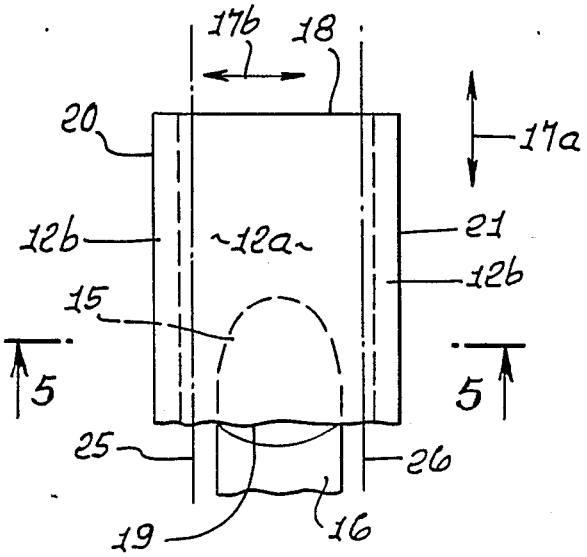
FIG. 4 is a plan view showing the FIG. 1 package applied to a natural fingernail.
Figure 4A:
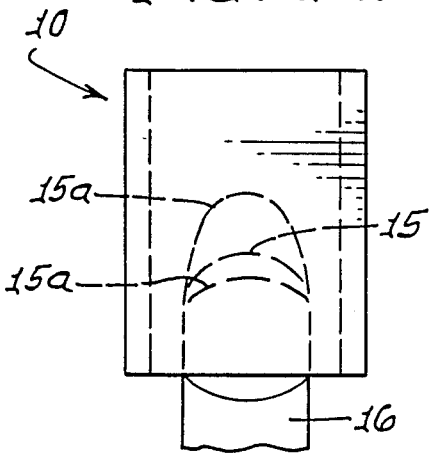
Figure 5:
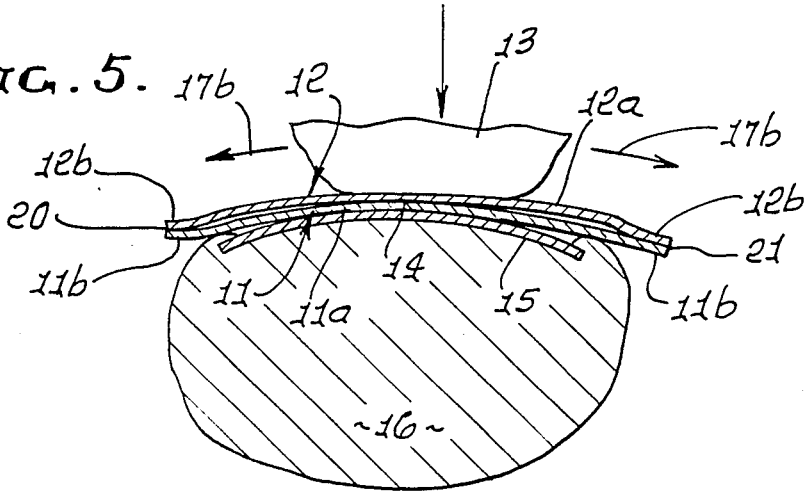

FIG. 4*a* is a view like FIG. 4 showing the FIG. 1 package applied to a natural fingernail to which a molded plastic fingernail extension or "tip" has been attached;

FIG. 5 is an enlarged section taken on lines 5—5 of FIG. 4;

FIG. 6 illustrates a sequence of steps (a)–(f) employed in performing the method of the invention.

DETAILED DESCRIPTION

Figure 2:
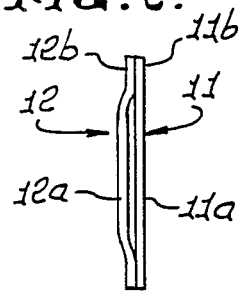
FIG. 2 is an end view taken on lines 2—2 of FIG. 1.
Figure 3:
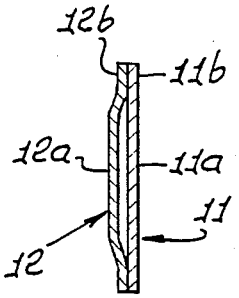
FIG. 3 is a section on lines 3—3 of FIG. 1.

In performing the nail strengthening method of the invention, a package as seen at 10 in FIGS. 1–3 may be employed. That package includes a fabric layer 11 and an overlay sheet 12 locally attached or retained to the layer 11 in such a way as to permit rubbing of the overlay sheet on and against the top of the fabric layer 11. Note FIG. 5 showing downward pressure exertion by the finger or digit 13 of one hand of the user against sheet 12, to cause rubbing contact at interface 14 between the underside of sheet 12, and the top surface of the fabric layer 11 applied to a fingernail 15 on a digit 16 of the user's other hand. Such rubbing contact is characterized by lateral and longitudinal displacement of that portion of the sheet 12 frictionally engaged by digit 16 relative to the fabric layer 11 in directions as indicated by arrows 17*a* and 17*b*, whereby smoothing, and enhanced or accelerated curing of adhesive adjacent the sheet 11 is produced More specifically, the package 10 may be rectangular as shown, with front, rear and side edges 18–21. The overlay sheet 12 includes first portion, as at 12*a*, free of attachment to first part 11*a* of the fabric layer, and second portion or portions 12*b* retained or attached to second part or parts 11*b* of the fabric layer. In use, the package is positioned with the first part or parts 11*a* of the fabric layer applied onto the top of the nail, and in the presence of liquid adhesive. The first portion 12*a* is then rubbed on and relative to part 11*a*, as referred to, to effect liquid adhesive or glue smoothing, removal of trapped air pockets, and accelerated curing of the adhesive. Portions 12*b* retained to fabric parts 11*a* serve to position the overlay sheet 12 on and directly over the fabric layer so that the user does not need to use his second hand to so position the sheet 11, during such rubbing.

In this regard, it has been found that when the overlay sheet consists of polypropylene film, and the glue or adhesive consists of cyanoacrylate, the rubbing action substantially accelerates the cure, for example reducing the cure time from 8 minutes to 30 seconds, for a glue of between 1,000 to 1,500 centipoise viscosity. The fabric may consist of linen, silk, glass fiber, or other cloth-like fabric material.

Referring again to FIG. 1, it will be seen that the second portions 12*b* of the plastic overlay sheet are typically heat sealed to the second parts 11*b* of the fabric layer along narrow, parallel and elongated heat seal zones located between edge 20 and edge 20', and between edge 21 and edge 21', such zones located at opposite sides of the first portion 12*a* of the plastic sheet and the first part 11*a* of the fabric layer. This construction facilitates disassembly of the package, during its use, as by cutting along parallel lines indicated at 25 and 26 seen in FIG. 4, and also in FIG. 6*c*, after the first part 11*a* of the fabric layer has become adhesively bonded to the nail top surface.

Referring now to FIG. 6 showing steps of the method, liquid adhesive such as cyanoacrylate is first applied at 27 to the top of a nail 15, as by applicator 28, as seen in FIG. 6*a*. The package 10 is then applied to the nail as seen in FIG. 6*b* and the digit 13 is applied to exert pressure onto overlay sheet 12 and to rub sheet 12 laterally and longitudinally on the fabric layer 11 to smooth out the latter, remove air bubbles, and to accelerate curing of any adhesive that penetrates upwardly through the porous structure of the fabric sheet.

Next, and as seen in FIG. 6*c*, the package is cut along the two lines 25 and 26, to separate the portions 12*b* and parts 11*b* from the overlay sheet portion 12*a* (which is not attached to the part 11*a*) and from the part 11*a*. Portion 12*a* is also lifted away from fabric part 11*a* now adhering to the nail.

Next, more adhesive 30 is applied to the top of the fabric part 11*a* over the nail, as by applicator 28, and as seen in FIG. 6*d*. The removed overlay sheet portion 12*a* is now re-applied to the glue 30 on the part 11*a*, and rubbed longitudinally and laterally (see arrows 17*a* and 17*b*) to smooth and spread the adhesive, and to accelerate curing thereof. See 6*e*. Thereafter, the overlay 12*a* is removed, and the fabric layer 11*a* overhanging the nail is trimmed away from the edges of the nail, as by a scissors. The final strengthened nail 15, trimmed fabric part 11*a* and cured adhesive, forming a smooth top surface 34, is seen in 6*f*, showing a completed wrap.

FIG. 4*a* shows use of the package 10 on natural nail 15 to which a plastic nail extension 15*a* has been attached.

The many advantages include natural look and feel of wrap (flexible on natural nails and not heavy); use on natural nails, tips, nail repair, and filling over acrylics; no yellowing of wrap, less maintenance of wrap, ease of removal (buff or use a wrap remover); no damage on removal; thinner appearance of wrap; strengthening and protection of nails, no strong odor emission, does not peel (no interference of nail glue by preback adhesive), is durable; enables choice of fabric type; wrap is sheer (silk and fiberglass cannot be seen) wrap is strong (especially the linen); enables choice of length (no predetermined length), no accelerator needed; cost savings i.e. uses less material-less waste; saves wrap application time; convenient for marketing; enables application with one hand; no fumes from accelerator; no yellowing of glue from accelerator; easy to control placement on the nail plastic, overlay is transparent so one can see where rubbing is effected, package is easy to grip and does not slip; plastic layer is reusable; smooth finish results; no fraying of wrap edges; ease of smoothing out air pockets; even distribution of the glue by use of the package(spreads out the glue); no high and low spots,; and smooth finish when dry.

Problems overcome by the present wrap, and which were encountered with prior wraps, and now overcome, include:

(a) application of wrap was time consuming—i.e. each piece had to be cut, individually, and later trimmed, and leading to wastage of wrap material,
(b) difficulty with correctly aligning the wrap on the nail, and difficulty with gripping the wrap, without slippage,
(c) edge fraying of wrap material,
(d) glue sticking on user's (applicator's) fingers
(e) need for glue cure accelerator spray, which contaminates atmosphere (accelerator needed for more viscous glues),
(f) problems with eliminating air pockets due to uneven glue distribution,
(g) cost of accelerator, objectionable fumes from accelerator, and yellowing of glue due to use of accelerator,
(h) glue brittleness and cracking due to use of accelerator,
(i) glue roughness caused by accelerator.

We claim:

1. The method of strengthening a nail, that includes:
(a) providing a package that includes a fabric layer to be applied to the nail, and a flexible plastic overlay sheet that includes a first portion positioned in overlying relation to a first part of the fabric layer and a second portion retained to a second part of the fabric layer,
(b) positioning said package to apply said first part of the fabric layer onto the nail and in the presence of liquid adhesive adjacent said first part of the fabric layer,
(c) and rubbing said first portion of the plastic overlay sheet against and relative to said first part of the fabric layer, thereby to smooth said first part of the fabric layer on the nail causing the adhesive to smoothly bond said first part of the fabric layer to the nail,
(d) and including maintaining said second portion of the plastic overlay sheet locally attached to the second part of the fabric layer during said rubbing.

2. The method of claim 1 wherein said positioning is carried out to locate said second portion and said second part spaced away from the nail.

3. The method of claim 1 wherein said rubbing is carried out to accelerate the curing of the adhesive.

4. The method of claim 3 wherein the liquid adhesive consists essentially of cyanoacrylate, and said plastic overlay sheet consists of polypropylene.

5. The method of claim 1 wherein said package is provided by heat sealing the second portion of the plastic overlay sheet to the second part of the fabric layer.

6. The method of claim 5 wherein said heat sealing is carried out to extend at zones at opposite sides of said first portion of the plastic overlay sheet and said first part of the fabric layer.

7. The method of claim 6 including disassembling the package after said rubbing by severing said zones from said first part of the fabric layer.

8. The method of claim 7 wherein said disassembling is effected by cutting said package between said first and second portions and between said first and second parts.

9. The method of claim 7 including applying additional adhesive to said first part of the fabric layer, and rubbing said plastic overlay sheet on said additional adhesive.

10. The method of claim 9 including trimming the fabric layer at the periphery of the nail.

11. The method of claim 1 wherein said fabric layer has a composition selected from the group consisting of
(i) linen
(ii) silk
(iii) glass fiber 12. The method of claim 1 that includes disassembling the package after said rubbing to remove the plastic overlay sheet from the fabric layer.

13. In apparatus for strengthening a nail, the combination that comprises:
(a) a flexible package that includes a fabric layer to be applied to the nail, and a flexible plastic overlay sheet,
(b) the overlay sheet including first and second portions, and the fabric layer including first and second parts, said second portion retained to said second part, and said first portion free of attachment to said first part,
(c) the package sized to be positioned with said first part of the fabric layer applied onto the nail in the presence of liquid adhesive, whereby rubbing of said first portion of the overlay sheet against and relative to said first part of the fabric layer effects smoothing of said first part of the fabric layer causing the adhesive to smoothly bond said first part of the fabric layer to the nail,
(d) the overlay sheet and the fabric layer having adjacent edges, and said second portion of the overlay sheet being attached to said second part of the fabric layer at local zones proximate said adjacent edges.

14. The apparatus of claim 13 wherein the plastic overlay sheet consists of polypropylene.

15. The apparatus of claim 13 wherein the overlay sheet consists of a material that accelerates the curing of the adhesive in response to said rubbing.

16. The apparatus of claim 15 including the adhesive adjacent the fabric layer, the adhesive consisting essentially of cyanoacrylate.

17. The apparatus of claim 13 wherein the fabric layer has a composition selected from the group consisting of
(i) linen
(ii) silk
(iii) glass fiber 18. The apparatus of claim 13 wherein said adjacent edges extend linearly, and said local zones extend parallel to said edges.

19. The apparatus of claim 18 wherein there are first and second pairs of said edges, the local zones extending proximate both of said pairs of edges.

20. In apparatus for strengthening a nail, the combination that comprises:
(a) a flexible package that includes a fabric layer to be applied to the nail, and a flexible plastic overlay sheet,
(b) the overlay sheet including first and second portions, and the fabric layer including first and second parts, said second portion retained to said second part, and said first portion free of attachment to said first part;
(c) the package sized to be positioned with said first part of the fabric layer applied onto the nail in the presence of liquid adhesive, whereby rubbing of said first portion of the overlay sheet against and relative to said first part of the fabric layer effects smoothing of said first part of the fabric layer causing the adhesive to smoothly bond said first part of the fabric layer to the nail,
(d) and including heat seal zones by which the second portion of the overlay sheet is attached to the second part of the fabric layer.

21. The apparatus of claim 20 wherein said zones are located at opposite sides of said first portion of the overlay sheet and said first part of the fabric layer.

22. The apparatus of claim 21 wherein said zones extend linearly as narrow bands.

* * * * *